US008381627B2

(12) United States Patent
Fannon et al.

(10) Patent No.: US 8,381,627 B2
(45) Date of Patent: Feb. 26, 2013

(54) METHOD FOR SEVERING TUBES USING AN EXPANDABLE SHAPE CHARGE POSITIONER

(76) Inventors: David Jacob Fannon, Daphne, AL (US); Gary Lee De Marsh, Slidell, LA (US)

( * ) Notice: Subject to any disclaimer, the term of this patent is extended or adjusted under 35 U.S.C. 154(b) by 0 days.

(21) Appl. No.: 13/555,633

(22) Filed: Jul. 23, 2012

(65) Prior Publication Data

US 2012/0285344 A1 Nov. 15, 2012

Related U.S. Application Data

(62) Division of application No. 12/604,831, filed on Oct. 23, 2009.

(51) Int. Cl.
*F42B 1/02* (2006.01)

(52) U.S. Cl. ..... 89/1.15; 102/305; 102/306; 102/307

(58) Field of Classification Search ..... 102/305–312; 175/4.55–4.59; 89/1.15, 1.151
See application file for complete search history.

(56) References Cited

U.S. PATENT DOCUMENTS

| | | | | |
|---|---|---|---|---|
| 4,116,130 | A | 9/1978 | Christopher et al. | |
| 4,787,315 | A * | 11/1988 | Kenny | 102/313 |
| 4,799,829 | A * | 1/1989 | Kenny | 405/195.1 |
| 5,031,540 | A * | 7/1991 | Kenny | 102/302 |
| 5,177,321 | A * | 1/1993 | Kenny | 102/312 |
| 5,467,824 | A * | 11/1995 | DeMarsh et al. | 166/297 |
| 5,477,785 | A * | 12/1995 | Dieman et al. | 102/313 |
| 5,525,010 | A * | 6/1996 | Kenny et al. | 405/195.1 |
| 5,777,257 | A * | 7/1998 | Kenny | 102/312 |
| 5,791,821 | A * | 8/1998 | Kiesler | 405/232 |
| 6,009,811 | A * | 1/2000 | Newman et al. | 102/312 |
| 6,035,935 | A * | 3/2000 | Regalbuto | 166/298 |
| 6,076,601 | A * | 6/2000 | Mooney, Jr. | 166/297 |
| 6,131,517 | A | 10/2000 | Poe | |
| 6,230,627 | B1 | 5/2001 | Poe | |
| 6,478,093 | B1 * | 11/2002 | Hilts et al. | 166/387 |
| 6,729,406 | B1 * | 5/2004 | Collins et al. | 166/297 |
| 6,805,056 | B1 * | 10/2004 | Poe | 102/307 |
| 2011/0094407 | A1 * | 4/2011 | Fannon et al. | 102/307 |

* cited by examiner

*Primary Examiner* — Michael David
(74) *Attorney, Agent, or Firm* — Mark O. Loftin

(57) ABSTRACT

A method of severing tubular members using an expandable linear explosive shape charge positioner. The method involves placing a plurality of arc-shaped charge chambers along the same plane and adjacent to the interior walls of a tube. Simultaneous detonation of the charge chambers severs the tube along a common plane. The positioner is placed within a tubular member and includes a remotely extendible framework with linear explosive shape charges enclosed therein. When in the collapsed position, the apparatus passes through constrictions within the tubular members. When extended, the framework is positioned transversely to the axis of the tubular member with the shape charges positioned adjacent the interior walls thereof. Shape charge chambers with angled ends are presented to provide overlap when the device is fully extended to better ensure complete separation of the tubular member at the discontinuities of the shape charges about the plane of severance.

5 Claims, 9 Drawing Sheets

METHOD FOR SEVERING TUBES USING AN EXPANDABLE SHAPE CHARGE POSITIONER

CROSS REFERENCE TO RELATED APPLICATIONS

This is a divisional application of U.S. application Ser. No. 12/604,831 filed on Oct. 23, 2009.

STATEMENT REGARDING FEDERALLY SPONSORED RESEARCH OR DEVELOPMENT

N/A

BACKGROUND OF THE INVENTION

A common industrial problem involves the cutting of tubular shape objects at points that are inaccessible, impractical, or unsafe using conventional torches or other human-held cutting tools. An example of this problem involves the demolition of offshore oil and gas production platforms. The legs of these production platforms are typically made from large diameter tubular steel members that are partially embedded on one end into the sea floor. These tubular legs then extend upward through the water to the surface where the external production structure is attached. These tubular legs serve both to anchor the platform to a fixed point and to support the super-structure at the surface where the oil and gas recovery and processing operations are performed. When the platform is demolished, the operations structure is first removed and the remaining platform and tubular legs must be subsequently disconnected from the sea floor. For complete removal of navigation hazards and elimination of hazards to the fishing and shrimping industries, it is necessary to comply with government requirements that the tubular legs be severed at a point below the sea floor level or "mud-line." The preferred method is to sever the tubular members using explosives below the mudline from the inside of the tubular member. It is desirable to use the smallest amount of explosives possible to achieve severance of the tubular members and not disturb the surrounding marine environment.

Most tubular members used in the oil and gas platform construction are generally comprised of short sections of pipe connected together by special load-bearing connectors. Therefore, the tubular member provides an open annulus where jetting and vacuum lines could be inserted and used to remove the mud to a point below the natural sea floor. One particular problem to placing and operating lines and cutting tools within the annulus results from the load-bearing connectors, which form internal constrictions at the various joining points within the interior of the length of pipe. Lines and cutting equipment must be able to navigate these constrictions without becoming snagged or jammed.

Many different types of cutting equipment are available, such as water jet cutters, underwater torches, underwater cutting wheels, etc. However, the most popular and cost effective means to cut these tubular members involves the use of commercially available linear explosive shape charges. Linear explosive shape charges, which use small amount of explosives to produce a directed cutting blaze, are particularly well suited for such applications and are comprised of elongated masses of explosive material having V-shape cross-sections. These types of charges must be positioned in a nearly continuous circle within the tube adjacent to the wall in order to achieve the complete circumferential severance of the tubular member. Upon detonation of such linear shape charges, because of the housing material and shape of the explosive, a substantial unidirectional explosive jet of high temperature and velocity is produced capable of deep penetration of metal thicknesses. However, it is essential that an air space exist between the shape charge and the target to be severed in that the jet produced must travel a distance before meeting incompressible liquids or other obstructions in order to achieve proper penetration. The length of the air space required between the shape charge and the target to achieve proper penetration of the target is known in the art as the "stand-off" distance. The requirement of placing the shape charge in a chamber that will provide this air space that can be transported to the depth needed and then expanded so that the chamber is within close proximity to the tubular wall is necessary to have a successful severance of the tubular wall.

FIELD OF THE INVENTION

Attempts to utilize shape charges for severing tubular members from the inside thereof, particularly tubular members having constrictions therein, have generally been unsuccessful due to the problems involved in passing linear explosive shape charges and the tool having one or more shape charge chambers included therein through the tubular members and obtaining the required stand-off between the walls of the tubular members and the linear explosive shape charges. Further, in applications where water or other fluids are contained within the tubular member to be severed, the presence of such fluids between the shape charge chamber and the walls of the tubular member interferes with the formation of explosive jets of required penetration ability.

In U.S. Pat. No. 4,116,130, Christopher et. al, first presented a shape charge positioner comprised of a remotely extendible framework having one or more remotely detonatable shape charges attached thereto. When retracted, the framework passed through the constrictions and was then extended via a mechanical means to move the shape charges into place against the interior pipe wall at the cutting point. Christopher included an inflatable bladder that claimed to ensure that the proper standoff distance maintained relative to the pipe wall for the shape charge to be effective. This tool proved difficult to position correctly, difficult to navigate the constrictions, and had no means to verify the shape charges were in correct position before firing.

In U.S. Pat. Nos. 6,131,517 and 6,230,627, Poe presents in his fourth embodiment, an improved shape charge positioner that can be remotely set at the desired location. This embodiment includes a frame having an upper and lower section that is attached to a cable for lowering to the desired cutting point. Prior to lowering into the tubular member, four arc-shape explosive charge chambers are tensioned into a retracted position and held in place by a plurality of cables. Once lowered into position, detonators on each of the tension cables are ignited and the cables are cut. Upper and lower springs provide the tension and when the retaining cables are severed, the shape charges extend outward until they contact the inside wall of the tubular member. Due to the particular mechanical design of this retracting/extending system, the shape charges are forced to make two different semi-circular planes on the inside diameter of the tubular member. Thus, when the shape charges are detonated, a continuous cut is not achieved and the tubular member must be re-detonated with a large amount of explosives or the cut completed by some other means.

These prior art tools have several deficiencies that prevent them effectively severing these tubular members correctly and with minimal damage to the surrounding marine environment. First, they employ large explosive charges to account for their inability to position linear explosive shape charge chambers consistently in the tubular member. Excessive blasting represents a danger to nearby marine environments and fishery personnel are typically employed during blasting operations to ensure wildlife is cleared from the area prior to detonation. Secondly, they require divers to descend into treacherous and hazardous enclosed environments to place explosive shape charges. Thirdly, they have mechanisms that require multiple actuators and multiple movements, which cannot be ensured to consistently deploy on every location under widely varying conditions. Fourthly, they often do not place the explosive shape charge chamber within the correct distance required from the structural tube wall to be effective. In most cases, they do not sever the structural tube wall in one explosive detonation. Once detonated, the tool is destroyed and a new tool or additional higher explosive placement steps must be undertaken. Fifthly, they do not work in the environment created below the mud line when suction pumps have just removed the mud buildup accumulated over years of platform operation. Agitation of marine sediments from the suction pumps makes the water completely turbid. Human personnel cannot position shape charges until the sediments have settled, which can take a significant amount of time. Sixthly, these tools do not provide any confirmation to the personnel at the surface that the tool is correctly positioned and ready for operation. Seventhly, they are not capable of collapse and expansion multiple times and therefore cannot be removed if something does not work properly. Finally, the inflatable tubes used in the prior art to ensure proper distancing to the tubular wall must be puncture proof and expand evenly in environments where pressures may exceed 200 psi.

What is needed in the art is a collapsible tool that can effectively and consistently transport down a tubular member and then on command, expand into a circular formation that will correctly position one or more linear shape charge explosive chambers within the tubular member below the mud-line.

What is further needed in the art is a shape charge chamber that has a durable and precise sealed air chamber so that standoff distance and shape charge position are assured prior to detonation.

What is further needed in the art is an effective severing means that uses less explosive material and has less impact on the surrounding marine environment.

What is further needed in the art is a severing means that provides remote feedback to the surface personnel indicating that placement is correct and includes a means for retrieving or repositioning in the event the initial placement attempt is unsuccessful.

What is further needed in the art is an expandable positioner that places the linear shape charge explosive chamber along a continuous common plane so that the tubular member will be severed completely in one detonation.

BRIEF SUMMARY OF THE INVENTION

The present invention provides a collapsible shape charge positioner for the severing of tubular members at inaccessible locations. In the collapsed state, the tool folds a plurality of rigid, arc-shape chambers into a partly vertical orientation such that the outside diameter of the tool is substantially reduced. The tool employs a top and bottom cone-shape guard to facilitate movement of the tool through constrictions within the tubular member to be cut. The guards also keep the tool from tilting on its side and allow it to remain in a substantially vertical position as it descends within the tubular member. The tool further includes a pressurized air tank and a pneumatic cylinder connected to a central rotating axle through a lever arm. Compressed air from the pressurized air tank is released by an electrically actuated valve to engage the cylinder and cause the central axle to rotate. Air in the opposite end of the air cylinder is released to an initial non-pressurized receiving tank through a separate port of the electrically actuated valve. As the axle rotates, the arc-shape chambers are rotated from the partly vertical collapsed position to the horizontal extended position. When fully extended, the arc-shape chambers form a near continuous, planar circumference along the inside diameter of the tubular member. Within each arc-shape chamber is placed a linear explosive shape charge with ignition detonator. All of the charges are wired together to detonate from remote control at the surface. The circular configuration of the expanded shape charge chambers places the explosives in the correct position to ignite a linear cut around the entire circumference of the structural tube no matter the slope of the tube interior. The mechanism's movement will straighten the entire tool by making the shape charge chamber quadrant that touches the wall first push the entire tool off an angled position into the correct position in relation to the tube wall for a linear cut. Sensors on the air cylinder will signal when the tool is either fully collapsed or fully expanded and ready for ignition of explosives. The linear actuator's movement is made reversible by directing compressed air to different ends of the air cylinder and collapse or expand the tool with a remote signal many times during operation at the pressures encountered within the tubular member.

DETAILED DESCRIPTION OF THE INVENTION

Figure 1:
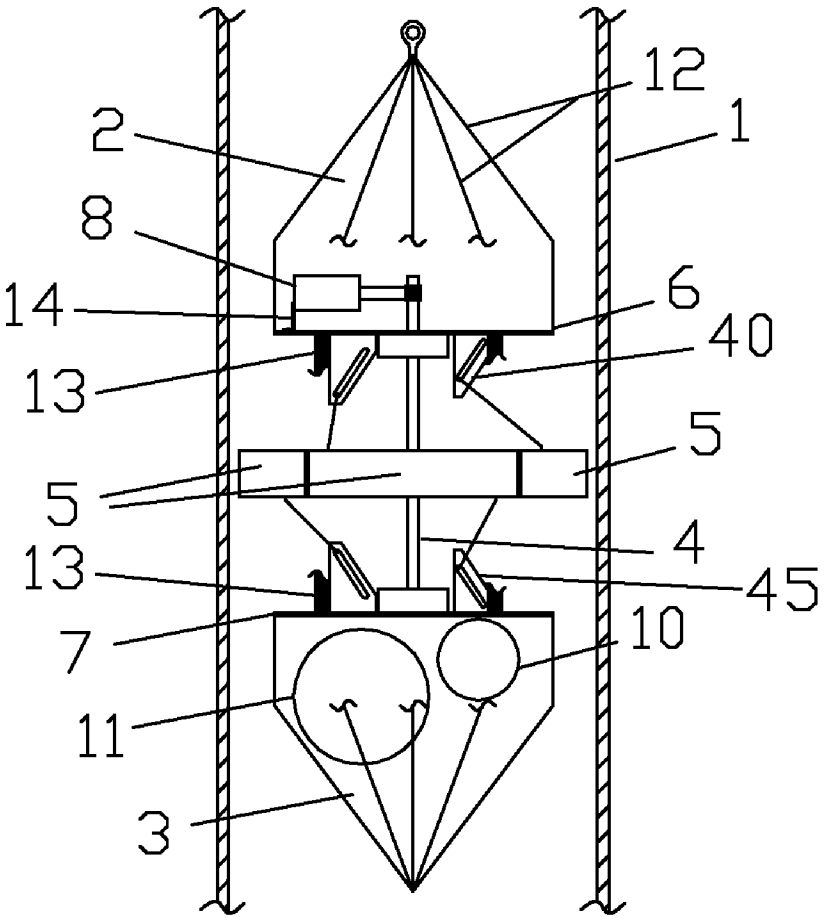
FIG. 1 is a side sectional view of the present invention within a vertical tubular member in the extended configuration.

In reference to FIG. 1, the current invention is shown in cross-section in the expanded position within a tubular member 1. The shape charge tool is comprised of an upper guide cage 2, a lower guide cage 3, a central axle 4, a plurality of arc-shape chambers 5, which house the linear explosive shape charges, and upper mounting disk 6, a lower mounting disk 7, a pneumatic cylinder 8 connecting the pneumatic cylinder shaft to the central axle, a pressurize air tank 10, and an air receiver tank 11. The upper and lower guide cages 2 and 3, are formed from a plurality of framing rods 12 that are attached together on one end and to the upper and lower mounting disks, respectively, on the other end. The plurality of framing rods 12 is evenly spaced around the circumference of the mounting disks and bent to the vertical a short distance away from the mounting disks. The bending of the rods allows the volume on the inside to be increased to accommodate the various components contained therein. A plurality of reinforcing rods 13 are evenly spaced around the axle 4 and attached on one end to the underside of the upper mounting disk and on the other to the topside of the lower mounting disk 7. These reinforcing rods 13 provide additional lateral strength to the invention to support the weight of the loaded shape charge chambers, maintain parallel alignment of the upper and lower mounting disks, and to distribute rotational forces applied to the central axle during movement of the mechanism.

Figure 2:
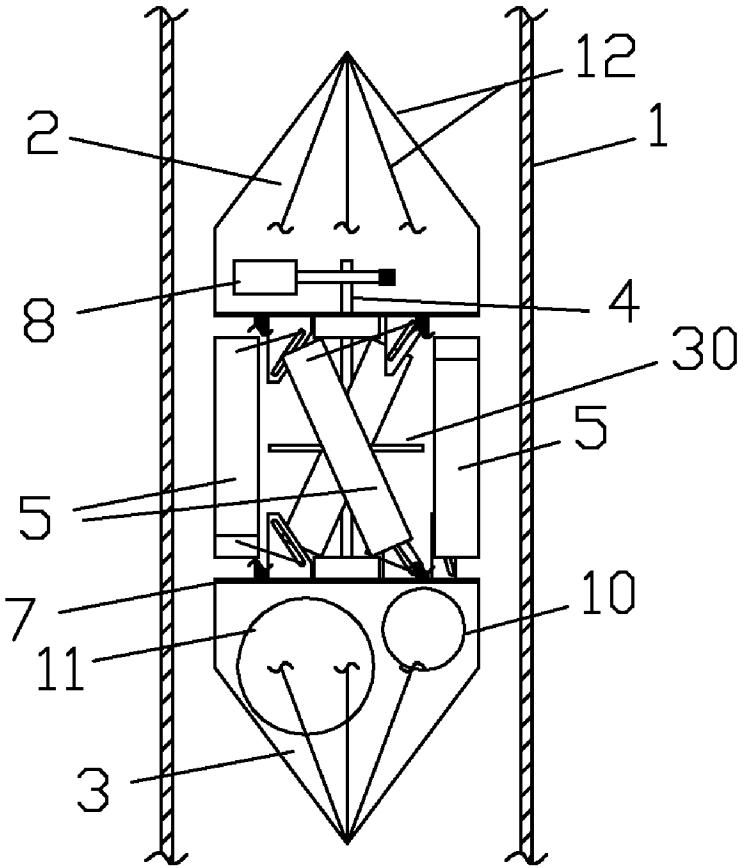
FIG. 2 is a side sectional view of the present invention within a vertical tubular member in the collapsed configuration.
Figure 3:
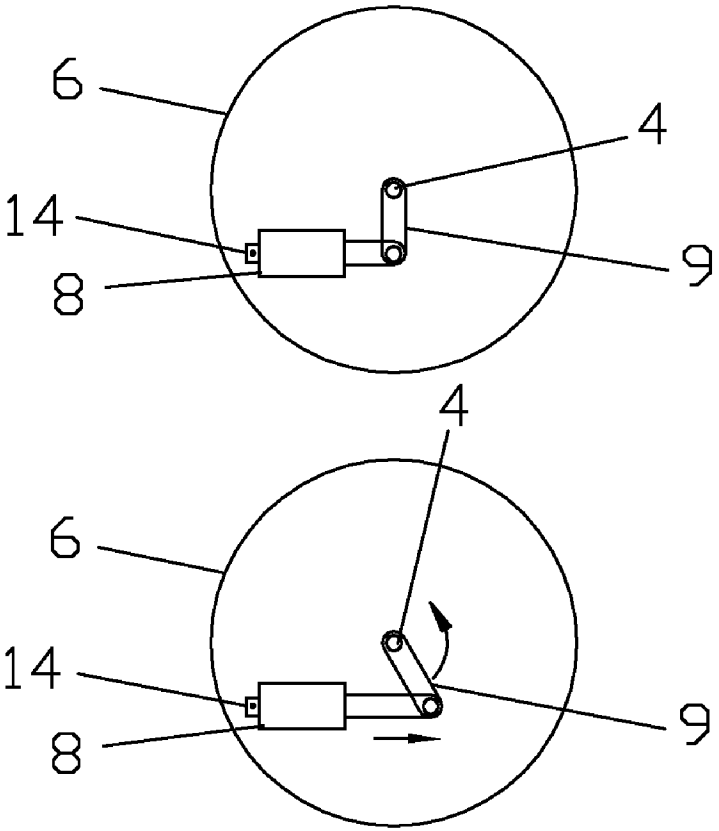
FIG. 3 is a plan view of the topside of the upper mounting plate showing the compressed air cylinder shaft in both the collapsed and extended position. As the cylinder shaft extends, the attached lever arm imports a rotational movement to the vertical axle.

In reference to FIG. 2, the current invention is shown in cross-section in the collapsed form within a tubular member 1. The mechanical movement of the linear explosive shape charge chambers from expanded to collapsed position is accomplished by rotation of a central operating wheel 30 attached to the central axle 3. As shown in FIG. 3, the pneumatic cylinder 8 is mounted to the topside of the upper mounting disk using a pivoting bracket 14. As compressed air enters the pneumatic cylinder, the cylinder's shaft extends. The lever arm 9 is attached on one end to the central axle 4 and on the cylinder's shaft. The extending movement of the cylinder shaft produces a rotational movement of the central axle 4. As the axle and attached mounting disks turn, the pivot bracket 14 also turns to allow the cylinder to rotate slightly to eliminate lateral forces applied to the shaft as it moves horizontally.

FIG. 1 shows the compressed air for the pneumatic cylinder to reside in a pressurized air tank 10. Air vented out of the pneumatic cylinder 8 during movement is collected in the air receiver tank 11. In the preferred embodiment, these two tanks are located in the space formed by the plurality of framing rods attached to the lower mounting disk that form the lower guide cage 3. It is understood that either of these tanks could be located in other open spaces without deviating from the basic concept presented by the current invention. Air from the pressurized air tank 10 is fed to the pneumatic cylinder 8 through an electrically actuated solenoid valve placed in the interconnecting line. When the surface operator desires to expand the tool, a switch connected to the electric solenoid valve is actuated into the position allowing the compressed air to pressurize the cylinder shaft extension port of cylinder 8.

Figure 4:
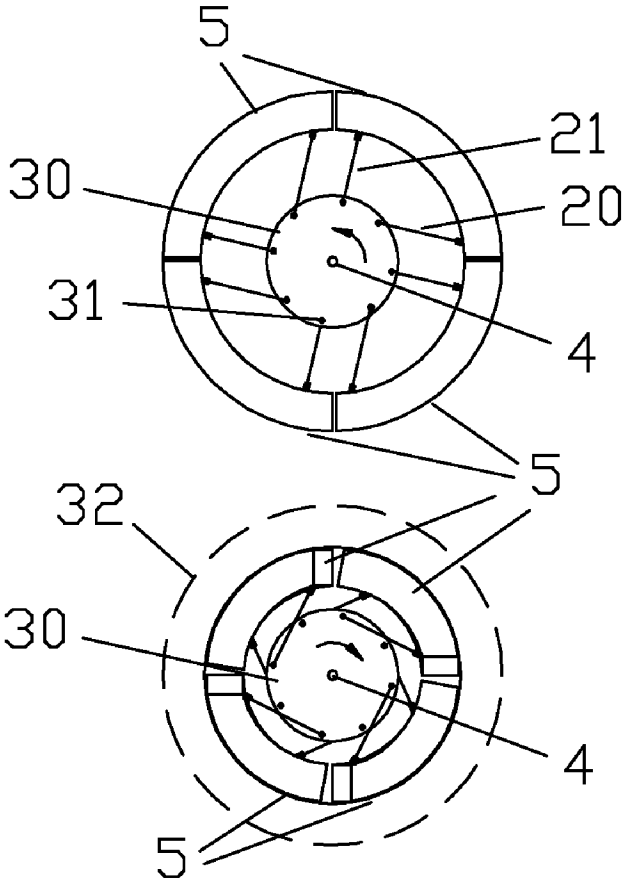
FIG. 4 is a plan view of the operating wheel showing the arc-shape charge chambers in both the collapsed and extended position. As the axle rotates, push/pull rods attached to the arcs and the operating wheel move the shape charge chambers in a rotational manner that increases or decreases the overall diameter of the arc-shape charge chambers when the vertical movement is compelled by the stationary pivot and angular slotted pivot/guide bracket with guiding rods attached to the shape charge chambers

In reference to FIG. 4, the central operating wheel 30 is shown in the two positions when the linear explosive shape charge chambers are in the extended and collapsed positions. Each of the shape charge chambers 5 are moved into place by a pair of push/pull rods 20 and 21. The forward push/pull rod 20 and the rear push/pull rod 21 are attached on one end to the forward end and rear end respectively of the shape charge chambers. In the embodiment of FIG. 4, the push/pull rods are attached to the inner face wall of the shape charge chambers near the forward and rear areas of the shape charge chambers. However, they could also engage the chambers on the lower or upper faces of the chamber. The other end of the push/pull rods is attached to the central operating wheel 30 in a plurality of spaced holes 31 placed around the outer circumference of the wheel.

The movement of the shape charge chambers from the collapsed to the extended position, and vice versa, employs both a radial displacement and an axial displacement that occurs simultaneously. This three dimensional movement is accomplished by the radial force of the push/pull rods 20 and 21 attached to each chamber 5 and the axial force of a second pair of pivot/guide rods (See FIG. 5) moving through pivot/guide slots attached to the upper and lower mounting plates. Since both the push/pull rods and the pivot/guide rods are connected on one end to the shape charge chamber, at some point along the rods axis, a standard swivel or universal joint is installed to allow three-dimensional rotation. In the preferred embodiment, each rod is fitted with a swivel joint near the end attached to the shape charge chamber mounting plates or the operating wheel. Thus when extended, the tool has an overall diameter as shown by the dotted line 32 in FIG. 4. But when collapsed, the overall diameter is significantly less. This reduction in diameter allows the tool to pass through constrictions in the tubular member it is moving through and also allows the tool to move the shape charge chambers into a common plane at a larger diameter when in the desired position.

Figure 5:
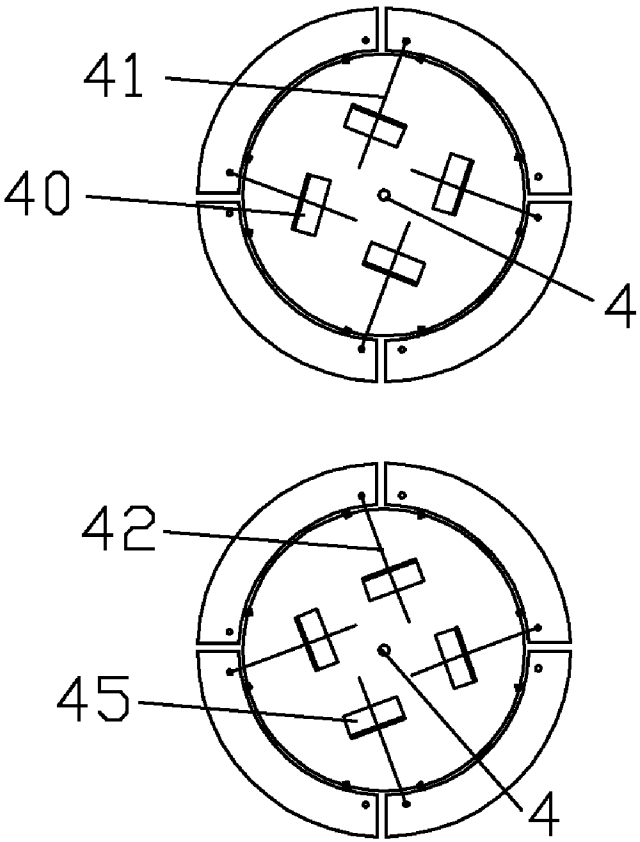
FIG. 5 is a plan view of the top side of the bottom rotor plate showing the stationary pivot and slotted guide vertical movement of the pivot/guide brackets with rods attached to the arc-shape chambers that move the chambers vertically into the collapsed and extended positions.

FIG. 5 shows the underside of the upper mounting plate (top figure) and the topside of the lower mounting plate (bottom figure). To each of these plates are attached a plurality of pivot/guide rod brackets 40. Each pivot/guide bracket is formed of a channel secured on middle side to the inner face of each mounting disk. One pivot/guide bracket is provided for each pivot/rod guide. In the preferred embodiment, which uses four shape charge chambers, a total of eight pivot/guide brackets are required. As best seen in FIG. 1, the perpendicular member of the pivot/guide bracket 40 extends toward the middle of the tool and contains an ovular slot aligned at an angle relative to the tool axis. In reference to FIG. 5, the upper pivot/guide rods 41 are attached on one end to the shape charge chamber. As stated earlier, since these pivot/guide rods travel in three dimensions, a standard swivel or universal joint is included at some point along the axis of the pivot/guide rod. In the preferred embodiment, the swivel joint for the pivot/guide rods is located near the end attached to the shape charge chamber. The other end of each upper pivot/guide rod is not attached and moves freely as the shape charge chamber moves both horizontally and vertically in one motion. The lower pivot/guide rods 42 are attached in a similar manner as the upper pivot/guide rods, with one end attached to the shape charge chamber with a swivel and the opposite end free to move as the shape charge chamber moves horizontally and vertically in one motion. Each of the upper and lower pivot/guide rods passes through the angled ovular slots of the bracket 40. When the push/pull rods 20 and 21 are moved by rotational action of the operating wheel 30, they impart a radial force on each end of each shape charge chamber. Simultaneously, the pivot/guide rods attached to the shape charge chamber with a swivel, as controlled by the angled ovular slots, direct the pivot/guide rods to provide a simultaneous axial force on each end of each shape charge chamber. The combined radial and axial forces applied to the ends of the chambers produces a vertical upward and downward motion as each chamber moves away or toward the axis of the central axle when the pneumatic cylinder 8 is extended or retracted. When fully collapsed, the shape charge chambers occupy a partly vertical position and have an overall diameter less than when extended. In the extended position, the push/pull rods push out and pivot/guide rods lower and raise each shape charge chamber and the combined motion maneuvers the shape charge chambers into a common horizontal circular plane. This common horizontal circular plane is very important to maximize the effectiveness of the shape charge explosion to sever the tubular member. By maximizing the effectiveness of the shape charge explosion, a lesser amount of the explosive may be used. When using the tool to sever underwater tubular members, the lesser the quantity of explosive used, the less impact the explosion will have on the surrounding marine environment.

Figure 6:
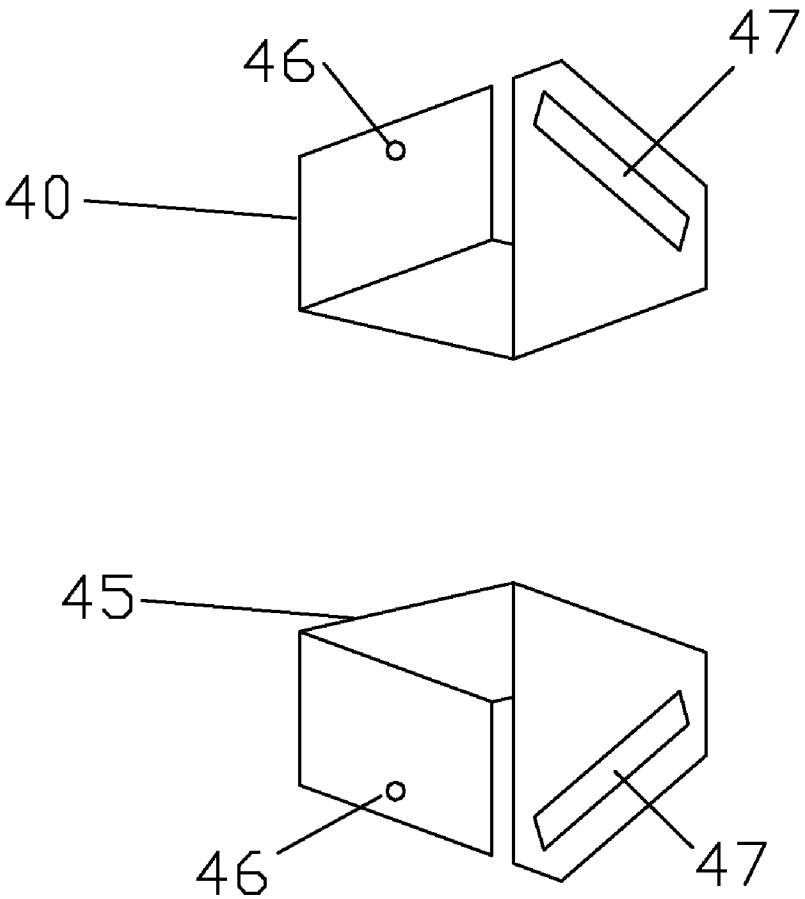
FIG. 6 shows the upper and lower pivot/guide brackets.

In reference to FIG. 6, the upper and lower pivot/guide brackets 40 and 45 are shown. Each bracket is comprised of one rigid piece of metal of other similar material that is bent into a u-shape or two right angled metal pieces that are then are placed together and bonded to form the u-shape. The bottom of the bracket is secured to the inner face of the upper and lower mounting disks 6 and 7. Each pivot/guide rod 41 extends through a pivot hole 46 drilled into one side of the bracket and extends to the chamber through the ovular slot 47. As the device rotates, the chambers are pushed outward. As the pivot/guide rods 41 extend outward as the chamber moves outward, the ovular slot 47 imparts a vertical movement on the rod, which lifts the rear end of the shaped chamber upward toward the central plane of the device. The pivot/guide rods are long enough so that when the chambers are fully extended, a portion of the rod remains extended through the pivot hole 46.

Figure 7A:
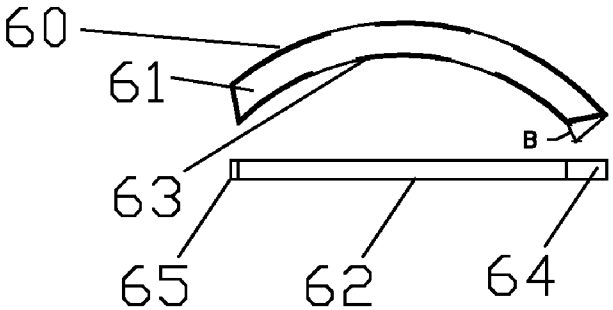
FIG. 7A shows a cross-section and plan view of the current invention showing an enclosed shape charge chamber with a curvature to match the tube that is to be cut and having a substantially square cross-section. The outer face of the chamber is rotated slightly about the central axis of the invention relative to the inner chamber face so that the chamber end caps form an angle.
Figure 7B:
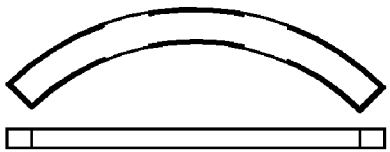
FIG. 7B shows an alternate embodiment of FIG. 7A where the center of the inner and outer chamber faces are aligned. In this embodiment, the chamber end plates are perpendicular to the central axis of the invention. To eliminate interference between adjacent chamber ends during movement, this embodiment results in a gap between adjacent chamber ends when fully extended.
Figure 7C:
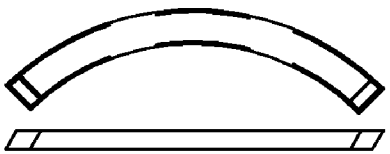
FIG. 7C shows the same basic configuration as FIG. 7A, but the top and bottom chamber plates are rotated instead of the inner and outer chamber face plates as shown in FIG. 7A. This is the preferred embodiment because the offset of the top and bottom chamber faces allows free clearance between adjacent chambers when the mechanism extends and produces the smallest gap between adjacent chambers when fully extended.

FIGS. 7A, 7B and 7C show three different embodiments of the shape charge chambers that can be used in carrying out the invention. Each of these embodiments represents a trade-off between ease and cost of fabrication versus the gap between each chamber when fully extended. By minimizing the gap between the chambers when extended, the shape charges are more likely to cut the tubular member at the point adjacent to that gap. In general, the thicker the tubular member to be cut, the less of a gap between the chambers can be tolerated to ensure complete severance of the tubular member. Since the invention operates by rotating the chambers to a common horizontal plane from a substantially vertical resting position, interference between the ends of the moving chambers is avoided by shortening the overall length of the chambers or applying a rotational offset of the various face of the chamber. In reference to FIG. 7A, each shape charge chamber is comprised of an outer faceplate 60, a top faceplate 61, a bottom faceplate 62, an inner faceplate 63, a forward endplate 64 and a rearward endplate 65. These faces form a hollow watertight chamber in which a linear explosive shape charge is inserted. The chamber is sealed with fastening devices and gaskets using various known methods. In the preferred embodiment, four linear explosive shape charges chambers are employed, which correspond to the four quadrants of the circle they form when extended in place. The required arc length and radius of each chamber is determined by the inside diameter of the tubular member to be severed. In FIG. 7A, the mid-point center of the outer faceplate 60 is rotated at an angle relative to the mid-point center of the inner faceplate 63. This rotation of centers results in an angle B that can be selected by the user from between 0 and 45 degrees, with 30 degrees being useful for many applications. FIG. 7B shows the inner and outer faceplates 60 and 62 with no offset rotation relative to one another. This embodiment is simpler to fabricate and is generally effective for thinner tubular walls. However, this configuration results in the largest gap between the chambers when fully extended because the chamber length is shorter to allow for clearance of the chamber ends during movement of the mechanism. FIG. 7C shows a third embodiment where instead of the inner and outer faceplates at an offset angle, the rotational offset angle is applied to the top and bottom faceplates 61 and 62. This rotation of centers results in an angle that can be selected by the user from between 0 and 45 degrees, with 30 degrees being useful for many applications. In this embodiment, the shape charge chambers create an overlap in the vertical orientation, and provide for the least amount of gap between the chambers when fully extended. This configuration is preferred for thicker tubular members.

Figure 8:
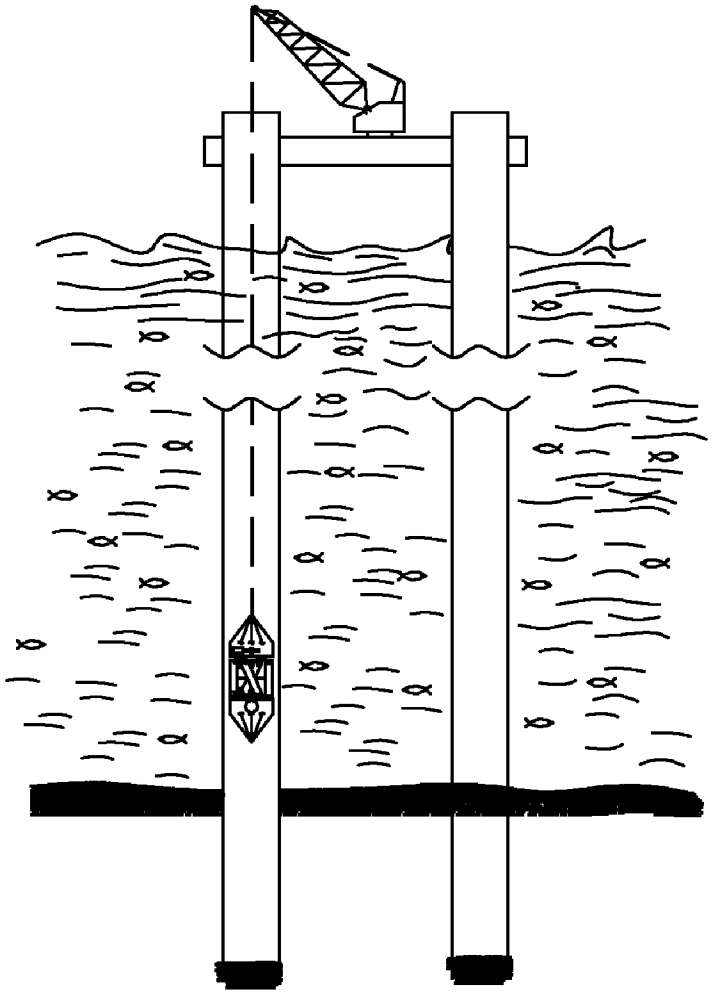
FIG. 8 shows the present invention being lowered down through a tubular member, used as an oil and gas platform leg, from a crane at the surface. The present tool is in the collapsed position.
Figure 9:
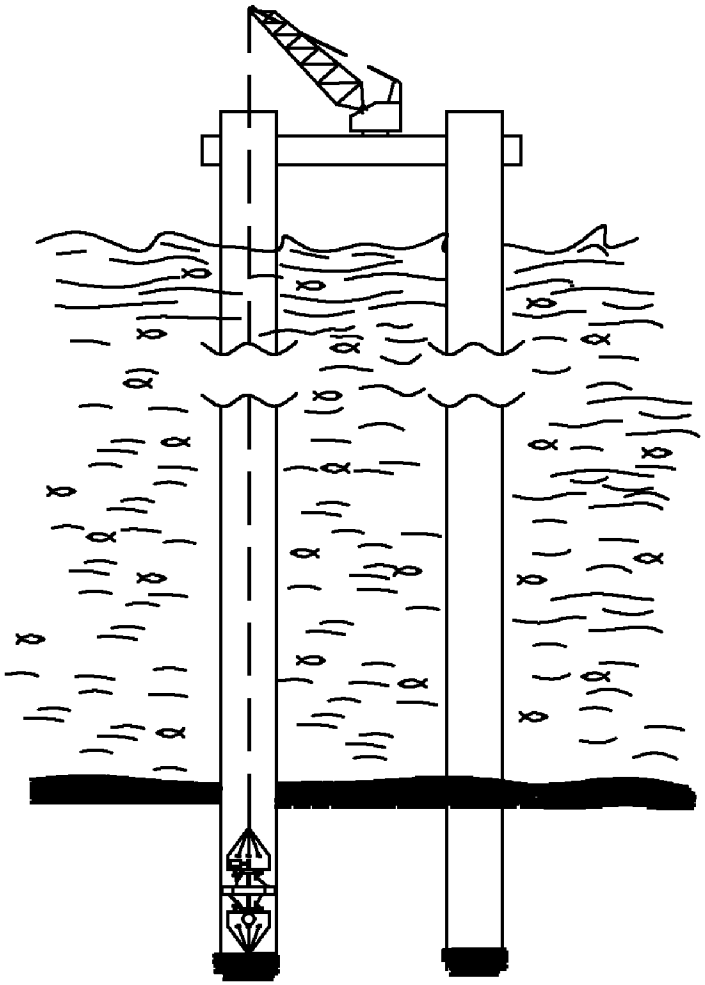
FIG. 9 shows the tool in FIG. 8 in position and extended, below the mud-line, and ready to detonate.

In reference to FIG. 8, the current invention is shown being lowered down one of the support legs of an ocean platform in the collapsed state. Prior to lowering, the tool into the tubular leg member, the mud and ocean sediments within the tubular member at the interface with the seabed are removed by others to a desired distance to create a annular space for the tool to descend below the mudline. In FIG. 9, the devise is shown at a position below the mudline and extended so that the shape charge chambers are resting against the inside diameter of the tubular member along a common plane. The blast from the detonation of the shape charges extends into the surrounding seabed and up through the tubular member to the surface, leaving the surrounding marine life unaffected.

What is claimed is:

1. A method of severing a tubular member comprising the steps of:

placing a tool within the interior of the tubular member at the point where it is desired to sever the member, said tool including a reversible actuator connected to a framework formed of four arc-shape shape charge chambers which when extended move from a collapsed semi-vertical position to an extended horizontal position forming a near continuous circle of shape charges in a common plane along the inside diameter of the tubular member, in the collapsed position, said tool and framework also including a pair of conical cages of larger overall diameter pointing upward and downward above and below the shape charge chamber, to allow the tool to pass through constrictions within said tubular member and when extended, said framework is positioned transversely to the axis of said member and said shape charge chambers are positioned adjacent the interior walls of said member;

extending said framework after said tool has been placed within said member by actuating the framework with sufficient force applied in equal directions so that the tool is centered within said tubular member and said shape charge chambers are positioned adjacent the interior walls of said member at said point in a common plane where it is desired to sever said member;

verifying the tool is in correct position before firing by use of proximity switches on the pneumatic actuator;

and detonating said explosive charges thereby completely severing said member.

2. The method of claim 1 which is further characterized to include the step of spacing said shape charges from the interior walls of said member using rigid, pre-sized chambers to provide the required stand-off prior to detonating said shape charges.

3. A method of severing a length of vertical or angled positioned pipe formed of a plurality of pipe sections connected together by connectors that form internal constrictions within said length of pipe comprising the steps of:

placing a tool within the interior of the tubular member at the point where it is desired to sever the member, said tool including a reversible actuator connected to a framework formed of four identical arc-shape charge chambers which when extended move from a collapsed semi-vertical position to an extended horizontal position forming a near continuous circle of linear explosive shape charges in a common plane along the inside diameter of the tubular member, in the collapsed position, said tool and framework also including a pair of conical cages of larger overall diameter pointing upward and downward above and below the shape charges, to allow the tool to pass through constrictions within said tubular member and when extended, said framework is positioned transversely to the axis of said member and said shape charge chambers are positioned adjacent the interior walls of said member;

extending said framework after said tool has been placed within said member by actuating the framework with sufficient force applied in equal directions so that the tool is centered within said tubular member and said shape charge chambers are positioned adjacent the interior walls of said member at said point in a common plane where it is desired to sever said member;

verifying the tool is in correct position before firing by use of proximity switches on the pneumatic actuator; and detonating said explosive charges thereby completely severing said member.

4. The method of claim 3 wherein each of said arc-shape parts of said framework have an elongated linear explosive shape charge inserted within the interior portions thereof.

5. The method of claim 4 wherein the step of centering the framework within said pipe is accomplished by attaching to each arc-shape chambers:

a pair of identically sized push/pull rods attached to a rotating central operating wheel, a pair of identically sized guiding rods attached to the arc-shape chambers rotating the central operating wheel so that each arc-shape chamber extends outward at an equal direction and equal rate so that when fully extended, each arc shape part of said framework is equidistant from the center axis of the framework forming a circular plane.

* * * * *